US008978195B2

(12) United States Patent
Park

(10) Patent No.: US 8,978,195 B2
(45) Date of Patent: Mar. 17, 2015

(54) VACUUM CLEANER USING AN INTELLIGENT POWER NETWORK

(75) Inventor: Daehwan Park, Changwon-si (KR)

(73) Assignee: LG Electronics Inc., Seoul (KR)

( * ) Notice: Subject to any disclaimer, the term of this patent is extended or adjusted under 35 U.S.C. 154(b) by 125 days.

(21) Appl. No.: 13/578,115

(22) PCT Filed: Feb. 11, 2010

(86) PCT No.: PCT/KR2010/000842

§ 371 (c)(1),
(2), (4) Date: Aug. 9, 2012

(87) PCT Pub. No.: WO2011/099659

PCT Pub. Date: Aug. 18, 2011

(65) Prior Publication Data

US 2012/0311812 A1 Dec. 13, 2012

(51) Int. Cl.
*A47L 9/28* (2006.01)
*G06F 1/32* (2006.01)

(52) U.S. Cl.
CPC ..... *A47L 9/2894* (2013.01); *A47L 9/2857* (2013.01)
USPC ..... 15/319; 15/339

(58) Field of Classification Search
CPC ..... A47L 9/2857; A47L 9/2894; A47L 9/2868–9/2884; A47L 9/2836
USPC ..... 15/339, 319; 700/295; 307/64–68
See application file for complete search history.

(56) References Cited

U.S. PATENT DOCUMENTS

| | | | | |
|---|---|---|---|---|
| 7,362,064 | B2 * | 4/2008 | Coates et al. | 318/286 |
| 7,561,977 | B2 * | 7/2009 | Horst et al. | 702/62 |
| 8,367,984 | B2 * | 2/2013 | Besore et al. | 219/490 |
| 2004/0078921 | A1 * | 4/2004 | Yuasa et al. | 15/319 |
| 2005/0115016 | A1 * | 6/2005 | Albert et al. | 15/412 |
| 2008/0222836 | A1 * | 9/2008 | Cunningham | 15/314 |
| 2008/0256742 | A1 * | 10/2008 | Bertram et al. | 15/327.2 |

FOREIGN PATENT DOCUMENTS

| | | | |
|---|---|---|---|
| JP | 2003-259551 | A | 9/2003 |
| JP | 2006-285934 | A | 10/2006 |
| KR | 10-2009-0085920 | A | 8/2009 |
| KR | 10-2010-0079474 | A | 7/2010 |
| KR | 10-2010-0083686 | A | 7/2010 |

* cited by examiner

*Primary Examiner* — Mark Spisich
*Assistant Examiner* — Andrew A Horton
(74) *Attorney, Agent, or Firm* — McKenna Long & Aldridge LLP

(57) ABSTRACT

A vacuum cleaner to perform a plurality of cleaning functions includes a main body including a suction motor, a nozzle to suction air and foreign material by using a suction power generated by the suction motor, and a handle disposed between the nozzle and the main body to be gripped by a user. A communication unit receives power information from an external, and a power management unit receives the power information from the communication unit. The power management unit determines a number of cleaning functions available to the vacuum cleaner among the plurality of cleaning functions based on the received power information, and a display unit displays the number of the cleaning functions determined by the power management unit to be available to the vacuum cleaner.

14 Claims, 10 Drawing Sheets

VACUUM CLEANER USING AN INTELLIGENT POWER NETWORK

This application claims the benefit of priority of PCT Application No. PCT/KR2010/000842 filed on Feb. 11, 2010, which is incorporated by reference.

TECHNICAL FIELD

The present disclosure relates to an appliance and in particular, to a vacuum cleaner using a smart grid.

BACKGROUND ART

In general, a power for operating electronic products used in home is provided from a power plant operated by public enterprises or private enterprises, through a transmission line, and a distribution line.

However, the above power has the nature of a central power source and not a distributed power source, has a radial-type shape that spreads from the center to the periphery, and is one-directional supplier-oriented and not consumer-oriented.

Due to this, only limited price information on electricity used is provided to a home, i.e., a consumer through a power exchange. Also, since a price system is actually a fixed-price system, there are limitations in selecting electricity at a price that consumers want.

In order to resolve the limitations and improve the efficiency of energy use, studies on a smart grid have been actively in progress in recent years.

The smart grid grafts information technology (IT) on a typical power grid to exchange real-time information in two way communication between a power supplier and a consumer. That is, the smart grid refers to a next generation power system and its management system for optimizing energy efficiency.

Moreover, in order to implement the above smart grid at home, the need on two-way communication relating to power supply source and power information, being free from the case that an individual electronic device unilaterally receives power from a network having a plurality of electronic devices connected, and also, the need on new devices for the two-way communication are being considered.

SUMMARY

Embodiments provide a vacuum cleaner using a smart grid, which is configured to display only a function available according to a supply mode of electricity supplied to an electronic product through the smart grid.

In one embodiment, a vacuum cleaner to perform a plurality of cleaning functions includes a main body including a suction motor, a nozzle to suction air and foreign material by using a suction power generated by the suction motor, and a handle disposed between the nozzle and the main body to be gripped by a user. A communication unit receives power information from an external, and a power management unit receives the power information from the communication unit. The power management unit determines a number of cleaning functions available to the vacuum cleaner among the plurality of cleaning functions based on the received power information, and a display unit displays the number of the cleaning functions determined by the power management unit to be available to the vacuum cleaner.

The present disclosure is configured to confirm and select a supply price and a supply amount of a power supply source, which is provided for operating a vacuum cleaner, through a main display of a main body.

Accordingly, a user may select a supply power according to an expected usage time and a cleaning type of a vacuum cleaner.

That is, when a cleaning task such as bedding cleaning or steam cleaning, which requires high power consumption, is expected, a user selects a power supply source that supplies sufficient power to use all functions of a vacuum cleaner for cleaning, and when a simple floor cleaning is expected, a user selects a low-priced power supply source with less supply amount for cleaning in an energy saving mode.

Due to this, the power consumption of the vacuum cleaner is reduced, and unnecessary power waste caused by user's cleaning preference may be prevented.

DETAILED DESCRIPTIONS OF THE EMBODIMENTS

Hereinafter, specific embodiments will be described with reference to the accompanying drawings. However, the idea of the present invention is not limited to suggested embodiments, and a person skilled in the art could easily suggest other embodiments within the range of the same idea.

Figure 1:
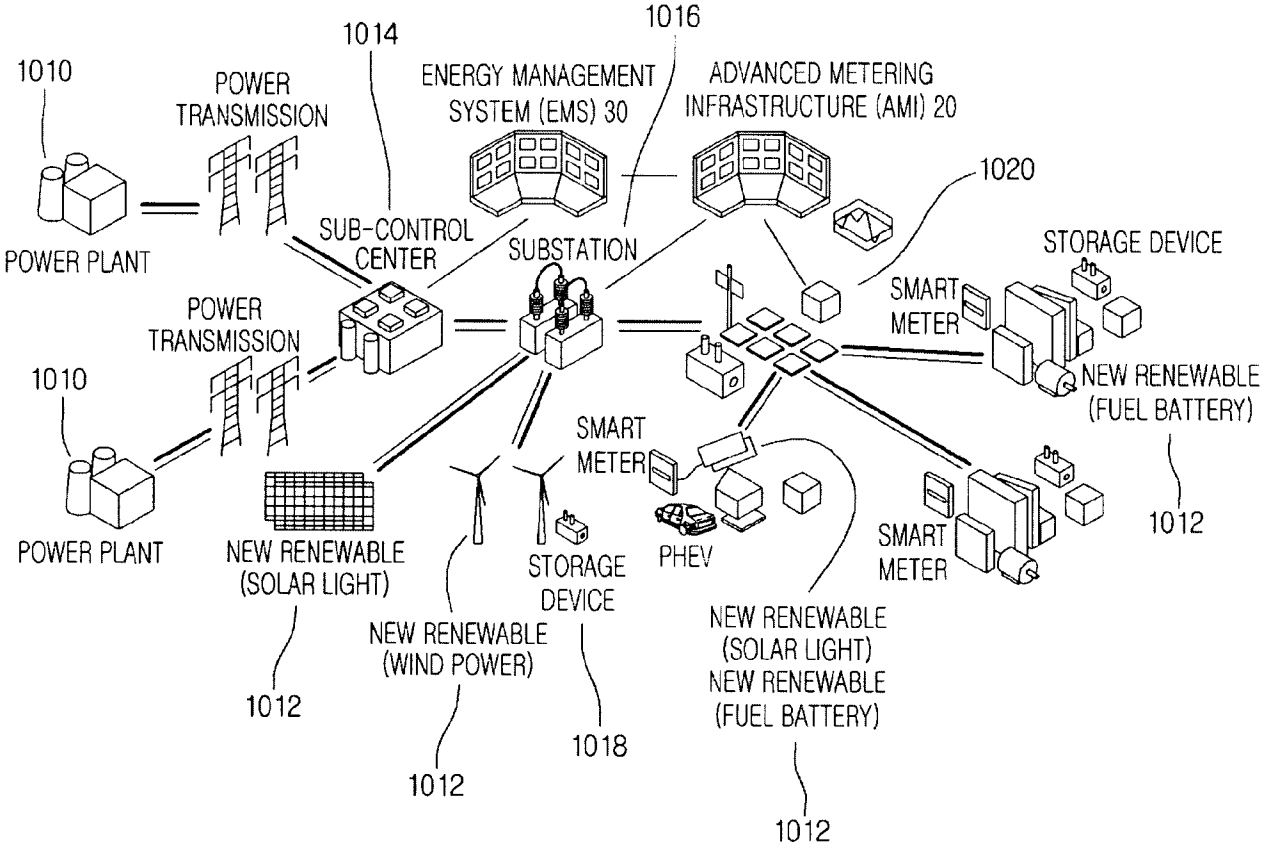
FIG. 1 is a schematic view of a smart grid structure according to an embodiment.
Figure 2:
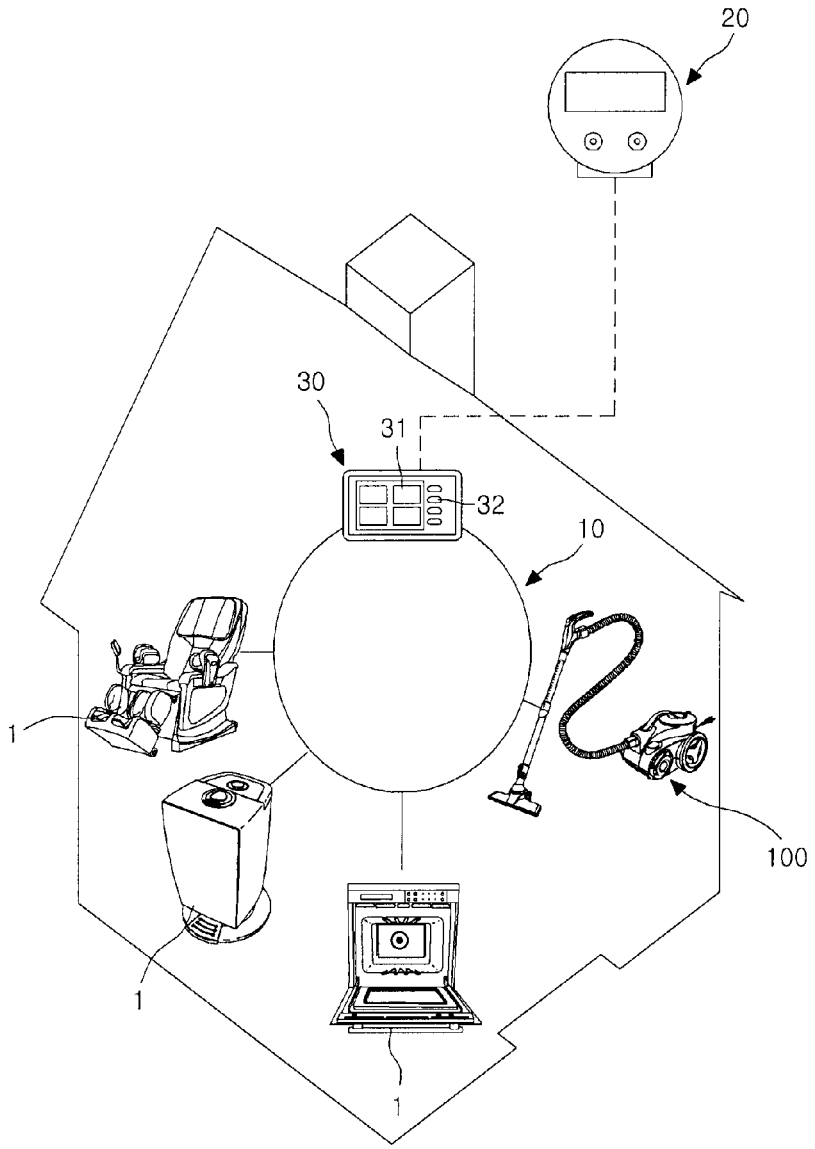
FIG. 2 is a schematic view illustrating a power supply structure of a vacuum cleaner according to an embodiment.

FIG. 1 is a schematic view illustrating a structure of smart grid according to an embodiment. FIG. 2 is a schematic view illustrating a power supply structure of an electronic product according to an embodiment.

As shown in the drawings, the smart grid includes a plurality of power plants 1010 and a plurality of power equipment 1012 using solar, wind, and fuel cells for power production. The power generated from the plurality of power plants 1010 and power equipment 1012 is transmitted to a sub-control center 1014.

The sub-control center 1014 receives the generated power and transmits the received power to a substation 1016, and the substation 1016 converts the received power into a voltage proper for home 1018 and production facilities 1020 and distributes the converted voltage to a consumer.

Additionally, an Advanced Metering infrastructure (AMI) 20 is prepared for a consumer such as a home or office in order to recognize the supplied power and electricity charge in real time. However, the smart grid includes an energy management system (EMS) 30 that is responsible for real-time power management of the consumer and real-time prediction of power consumption in connection with the AMI 20.

Here, the AMI 20 provides a capability for allowing a consumer to efficiently use electricity and allowing a power supplier to efficiently operate a system by detecting system problems, as generic technology that integrates consumers on the basis of an open architecture in a smart grid.

That is, in the smart grid, the AMI 20 provides a standard by which all electronic appliances are connected to each other regardless of manufacturers, and a real time price signal of an electricity market supplied through the AMI 20 is transmitted to the EMS 30 in the consumer.

Additionally, the EMS 30 distributes power to a plurality of electronic devices including the vacuum cleaner 100, and connects the electronic devices for communication in order to recognize power information of each electronic device. Based on this, the EMS 30 performs a power information process such as the power consumption amount or electricity charge limit setting, so that energy and cost reduction may be achieved.

Figure 4:
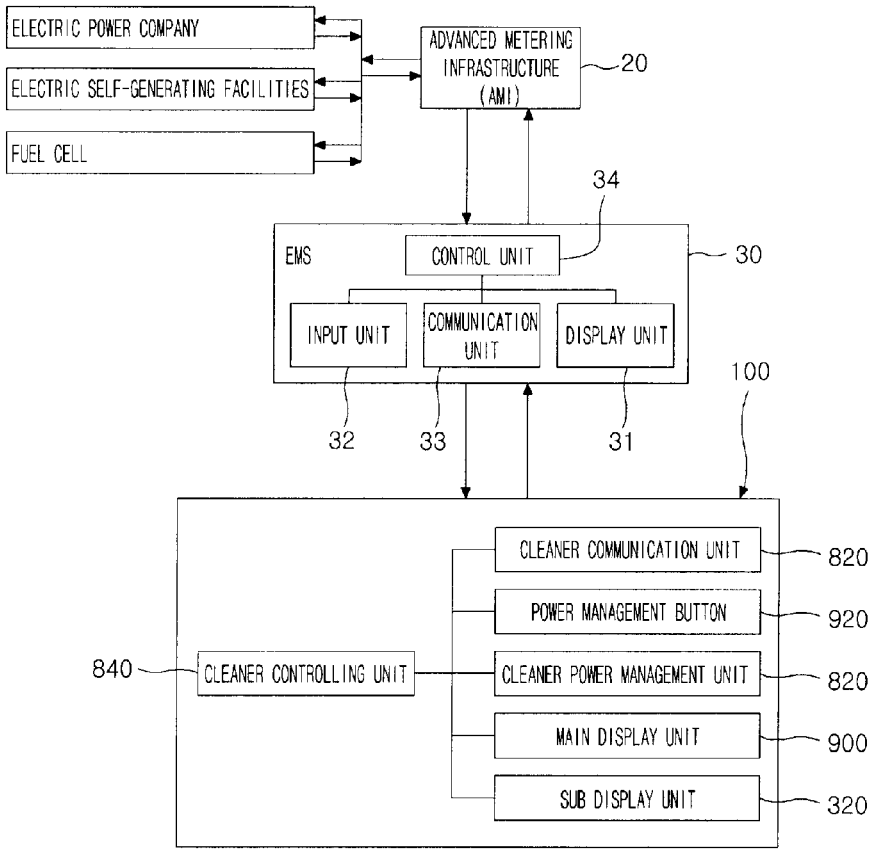
FIG. 4 is a block diagram illustrating a control structure of a vacuum cleaner and a power supply network, according to an embodiment.

For this, referring to FIG. 4, the EMS 30 includes a control unit 34, an input unit 32, a communication unit 33, and a display unit 31, and their descriptions will be made below in more detail.

Moreover, as shown in FIG. 2, the EMS 30 supplies power to an electronic device 1 mainly.

That is, a power supply network 10 in the consumer is established including the AMI 20 for measuring a supplied power, an electricity charge, and a power consumption peak time section, and the energy EMS 30 connected to the AMI 20 and a plurality of electronic products 1 for two-way communication and responsible for transmitting and receiving a control signal to distribute power to each of the plurality of electronic products 1.

Here, the EMS 30 includes a display unit 31 for displaying a current electricity consumption status and external environments (for example, a temperature, a moisture, and so on), an input unit 32 for user's manipulation, a communication unit 33 for communicating with the plurality of electronic products 1 via wireless or wire such as PLC, and a control unit 34 for processing a control signal.

That is, the AMI 20 and the EMS 30 are connected for two-way communication. The vacuum cleaner 100 is connected to the power supply network 10 through a cleaner plug 120 of FIG. 3, receives an operating power on the basis of information provided through the EMS 30, and performs two-way communication.

Hereinafter, this will be described in more detail with reference to the accompanying drawings.

Figure 3:
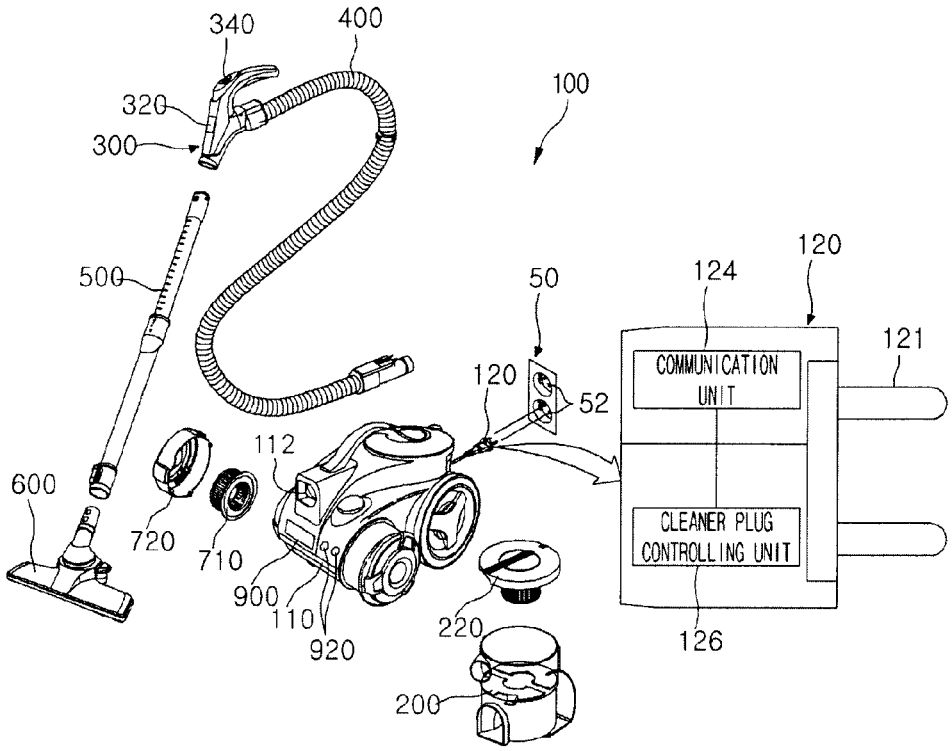
FIG. 3 is a view illustrating a detailed configuration of a vacuum cleaner according to an embodiment.

FIG. 3 is a view illustrating a detailed configuration of a vacuum cleaner according to an embodiment. FIG. 4 is a block diagram illustrating a control structure of a power supply network according to an embodiment.

Referring to the drawings, the vacuum cleaner 100 includes a nozzle 600 for suctioning air with dust, a handle 300 for manipulating an operation of the vacuum cleaner by a user, an extension pipe 500 for connecting the nozzle 600 with the handle 300, and a connection hose 400 for connecting the nozzle 600 with a main body 110 and guiding the suctioned air and dust to the main body 110.

Also, the handle 300 includes a control button 340 for controlling a suction power, being gripped by a user, and a sub display unit 320 for displaying operational functions of the vacuum cleaner 100. The sub display unit 320 will be described in more detail below.

The main body 110 includes a suction part 112 for suctioning a foreign material with air, and the connection hose 400 is combined with the suction part 112.

Additionally, a detachable dust container 200 for separating the foreign material from the air inflowing through the suction part 112 and storing the foreign material may be mounted at the main body 110, and the dust received in the dust container 200 may be emptied out by removing a dust container cover 220 that covers the top of the dust container 200.

Moreover, the main body 110 includes a discharge filter 710 for preventing fine dust from being included in the discharged air when the air separated from the dust is discharged to an external, and a filter cover 720 for fixing the position of the discharge filter 710.

Additionally, the vacuum cleaner 100 includes a cleaner plug 120 for delivering operating power to the main body 110 and providing two-way communication in connection with the power management network 10.

For this, the cleaner plug 120 includes a cleaner plug combining part 121 that inserted into a socket 52 in an outlet 50 constituting the power management network 10, a communication unit 124 for delivering a control signal through the power management network 10 connected through the cleaner plug combining part 121, and a cleaner plug controlling unit 126.

That is, when the cleaner plug 120 is connected to the socket 52, an operating power of the vacuum cleaner 100 may be provided through the EMS 30. A user may determine the operating power from a plurality of power supply sources supplied through the EMS 30, which are displayed on a main display unit 900 at one side of the main body 110.

The main display unit 900 is configured to have a liquid crystal display or a display structure having an equivalent function thereof in order to display built-in characters or figures according to programmed contents, and is programmed to display different colors according to displayed information.

Additionally, the main body 110 includes a cleaner power management unit 820 therein to manage the supplied power.

That is, the cleaner power management unit 820 requests a power selected by a user to the EMS 30, and receives the power in communication with the EMS 30.

For this, the main display unit 900 displays price information for each power supply source and information on available supply capacity provided from the EMS 30, so that a user may confirm the displayed information and select a desirable power supply source, which is to be used as an operating power of the vacuum cleaner 100.

Figure 5A:
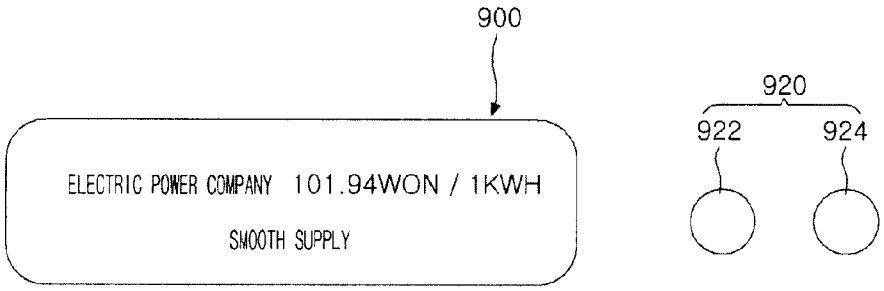
FIGS. 5A-5C are views illustrating a main display unit of a vacuum cleaner according to an embodiment.
Figure 5B:
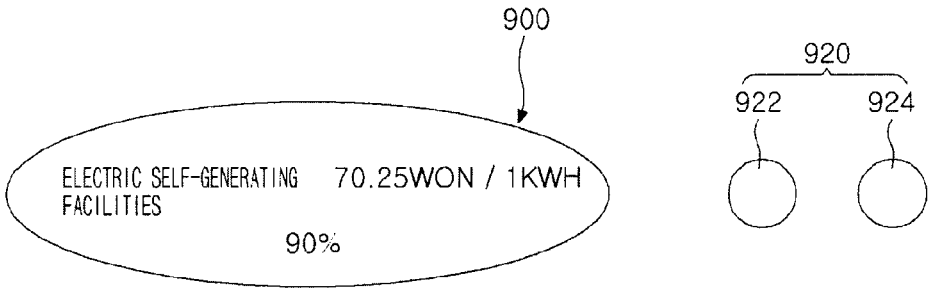
Figure 5C:
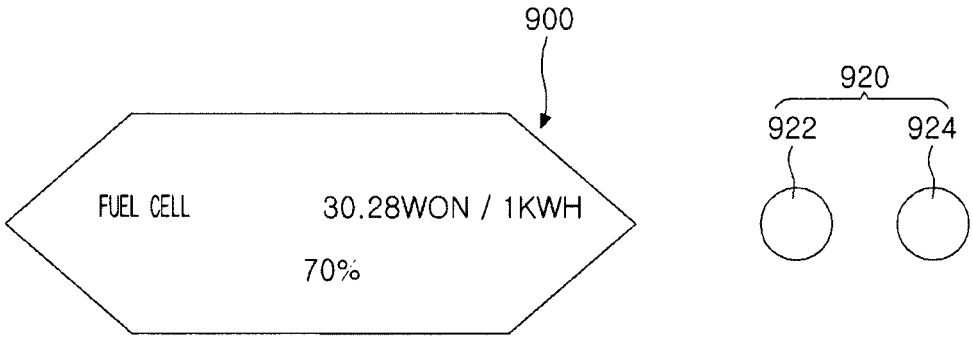

For detailed description, FIGS. 5A-5C are views illustrating a main display unit of a vacuum cleaner according to an embodiment.

A power supply price per 1 KWH that a power company provides and an available supply amount to the vacuum cleaner 100 are shown in FIG. 5A.

Additionally, a power supply price per 1 KWH provided through self-generation equipment and an available supply amount to the vacuum cleaner 100 are shown in FIG. 5B. Also, a power supply price per 1 KWH provided through self-generation equipment and an available supply amount to the vacuum cleaner 100 are shown in FIG. 5C.

A power management button 920 is provided at one side of the main display unit 900, so that a user may change information provided through the main display unit 900 and confirms it in order to select one of confirmed information to be used as an operating power of the vacuum cleaner 100.

The power management button 920 includes a selection button 922 for changing a power supply source displayed through the main display unit 900 each time it is pressed, and a confirmation button 924 for setting a power reception through the displayed power supply source.

That is, each time the selection button 922 is pressed, information on a power supply source is sequentially changed on the main display unit 900, and when confirmation button 924 is pressed, a power supply request signal is generated to supply power from the power supply source to the EMS 30.

Here, the information on a power supply source displayed each time the selection button 922 is pressed is programmed to display its contents and forms distinctively. Therefore, a user may easily confirm and select the information.

That is, according to the importance of a supply capacity of the power supply source, a chroma in a main background is changed and power supply information is displayed, so that a user may confirm a power supply amount only with color without confirming the power supply information.

The user, who confirms the displayed content, manipulates the selection button 922 to confirm the price information and supply amount of available power, so that an operating power is provided from the power supply source selected through the confirmation button 924 to the cleaner power management unit 820.

Moreover, the cleaner power management unit 820 confirms the supply amount of the power supplied, and selectively limits some functions of the vacuum cleaner 100 according to the supply amount.

Here, the confirmation criteria of the power supply amount is obtained by comparing a power consumption amount per cleaner operating hour set in the cleaner power management unit 820 with a supply available power amount delivered through the energy management device 30.

Moreover, the cleaner power management unit 820 supplies power in a normal mode, in which all functions of the vacuum cleaner 100 are available, when the supply amount of the selected power supply source is sufficient.

On the contrary, if the supply amount of the selected power supply source is insufficient, the cleaner power management unit 820 supplies power in an energy saving mode, in which some functions are limited in order of high power consumption according to the power supply amount.

That is, the cleaner power management unit 820 confirms a supply amount of power, which is selected by a user and supplied from the EMS 30, and if the supply amount is insufficient, a power circuit is configured to limit a bedding cleaning function or a maximum suction power function of high power consumption, for example.

That is, a relay circuit or a switching circuit is provided at one side of a circuit for operating the above functions. According to a power supply status, limiting the functions may become possible by selectively operating the relay circuit or the switching circuit.

Moreover, the sub display unit 320 at the handle 300 displays only available functions in order for a user to confirm the function limiting status.

Figure 6:
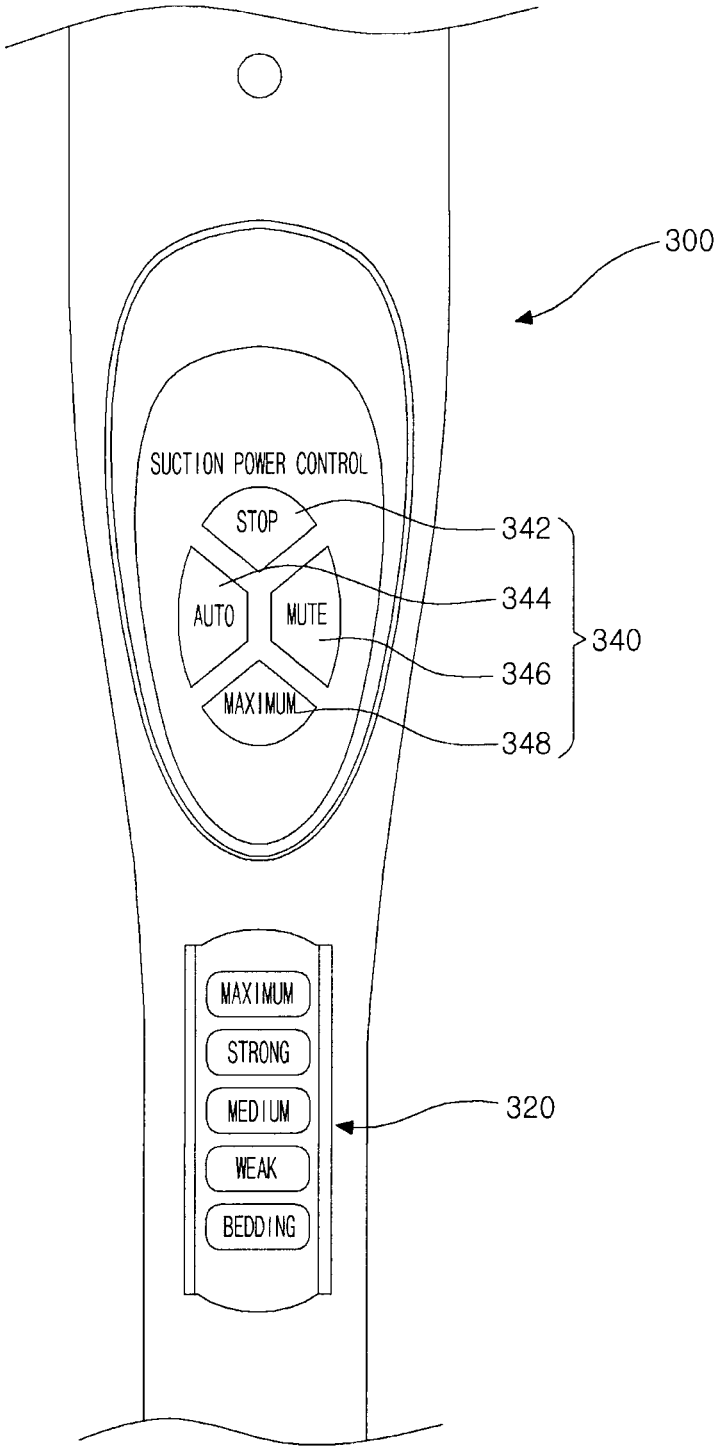
FIG. 6 is a view illustrating a handle according to an embodiment.
Figure 7:
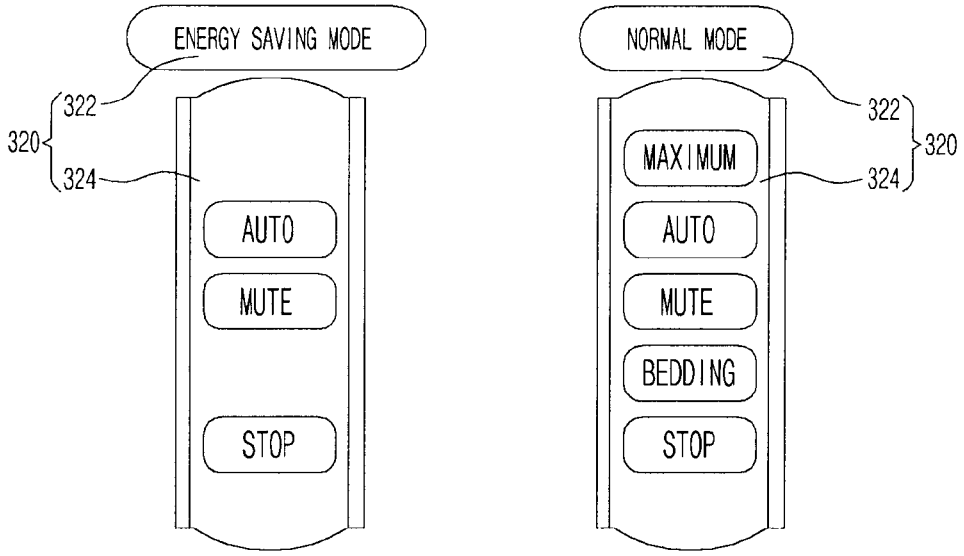
FIG. 7 is a view illustrating a sub display unit at the handle of FIG. 6.

For detailed description, FIG. 6 is a view illustrating a handle 300 according to an embodiment. FIG. 7 is a view illustrating a sub display unit 320 at the handle 300 of FIG. 6 according to an embodiment.

As shown in the drawings, there is a control button 340 including a plurality of buttons at the handle of the vacuum cleaner 100, which is used when being gripped by a user if necessary.

The control button 340 includes a stop button 342 for stopping an operation of the vacuum cleaner 100, a mute button 346 for reducing noise when a cleaning task requiring low power consumption is performed, an auto button 344 for performing a general cleaning, and a maximum button 348 for strong suction power.

Then, the maximum button 348 may further have a function that operates a nozzle for bedding cleaning when a user removes the nozzle 600 and attaches the nozzle for bedding cleaning during cleaning of the bedding.

Moreover, a sub display unit 320 at the handle 300 includes a mode display unit 322 for displaying a power mode of the vacuum cleaner 100 and a function display unit 324 for displaying available functions of the vacuum cleaner 100 according to a power supply mode displayed on the mode display unit 322.

In more detail, if the power supply amount selected by a user is sufficient, a character notifying a normal mode or a distinguished color is displayed so that a user may confirm a power supply mode.

Moreover, since the function display unit 324 displays functions only available in the selected mode, a user confirms the functions and performs a cleaning task.

That is, when a user confirms the information through the main display unit 900 and sufficient power is supplied from the selected power supply source, a character or color that notifies a normal mode is displayed on the mode display unit 322, and a status that shows all functions such as the auto, mute, maximum, and stop functions are available is displayed on the function display unit 324.

Furthermore, the above bedding cleaning function is displayed on the sub display unit 320 when the nozzle for bedding cleaning is mounted, and in this case, the maximum function is not displayed.

Moreover, although not shown in the vacuum cleaner 100, if a cleaner has a steam cleaning function, whether the stream cleaning function is available may be displayed on the sub display unit 320.

For this, the function display unit 324 of the sub display unit 320 includes a panel having all functions of the vacuum cleaner 100 displayed, a housing for partitioning a space corresponding to the content displayed on the panel, an LED received in the space partitioned by the housing and emitting light, and components on a PCB for controlling the light of the LED.

Figure 8:
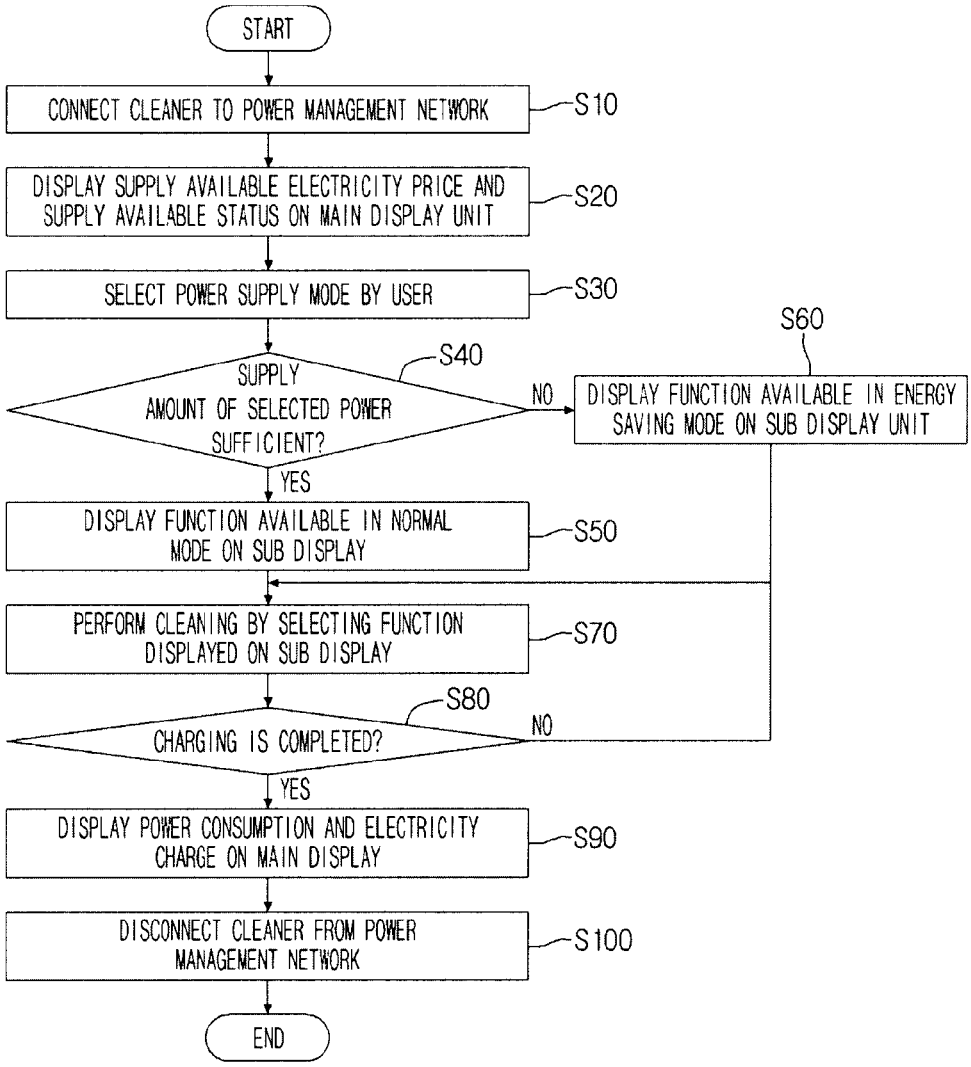
FIG. 8 is a flowchart illustrating an operating process of a vacuum cleaner according to an embodiment.

Hereinafter, referring to FIG. 8, operations of the embodiment having the above configuration will be described.

In order to perform a cleaning task by using the vacuum cleaner 100, a user plugs the cleaner plug 120 in the socket 52, which is connected to the AMI 20 and EMS 30, to connect the vacuum cleaner 100 to the power management network 10 (S10).

Once the vacuum cleaner 100 is connected to the power management network 10, the main display unit 900 displays a supply electricity charge and a supply amount of a power supply source available for an operating power of the vacuum cleaner 100 (S20).

When the power supply information is displayed on the main display 900, a user manipulates the selection button 922 in order to confirm a power supply resource that is used as an operating power of the vacuum cleaner 100, and then selects a power supply source by using the confirmation button 924 (S30).

Moreover, as the voltage supply source is selected as mentioned above, it is confirmed whether the amount of power supplied through the cleaner power management unit 820 is sufficient or not (S40).

Here, if the power supply amount is sufficient, the cleaner power management unit 820 supplies power to operate the vacuum cleaner 100 in a normal mode, and all functions available in the normal mode may be displayed on the sub display unit 320 through the function display unit 324 (S50).

On the contrary, if the power supply amount is insufficient, the cleaner power management unit 820 supplies power to operate the vacuum cleaner 100 in an energy saving mode, and all functions available in the energy saving mode may be displayed on the sub display unit 320 through the function display unit 324 (S60).

A user confirms the above content, and selects an operating mode of a cleaner, in order to perform a cleaning task (S70). Once the cleaning task is completed, the main display unit 900 receives and displays the power amount consumed and electricity charge, provided through the EMS 30, so that the user may confirm the displayed information. The charge of the power supply source may be continuously observed (S80). If the charge of the power source supply source is below a certain amount, the cleaner power management unit 820 supplies power to operate the vacuum cleaner 100 in an energy saving mode, and all functions available in the energy saving mode may be displayed on the sub display unit 320 through the function display unit 324 (S60). Otherwise, the power consumption and the electricity charge is displayed on the main display (S90). Once the cleaning has been completed, the vacuum cleaner 100 is disconnected from the power management network 10 (S100).

According to the embodiments, power supply information provided from a plurality of power supply sources is displayed by a vacuum cleaner, and through the displayed content, a user may directly select a power supply source. Accordingly, a lower-priced power supply source may be easily selected for cleaning, if necessary.

Additionally, according to a supply amount of a power supply source that a user selects, a vacuum cleaner separately operates in a normal mode or an energy saving mode, and also only available functions are displayed to a user according to a separated energy supply mode.

Therefore, energy waste is reduced during a cleaning task, and since a user selects a power supply mode as needed, more deliberated cleaning may be done.

Thereby, energy saving and reduced cleaning time are provided. Therefore, it is expected that a vacuum cleaner according to the present invention may be very useful for energy saving and improvement of user's cleaning preference.

Although, the embodiments were described with respect to a vacuum cleaner, the principles of the invention may be used in various appliances, such as, a washing machine, a dryer, a cooking appliance, a microwave oven, a dishwasher, a refrigerator, and the like.

The invention claimed is:

1. A vacuum cleaner to perform a plurality of cleaning functions, comprising:

a main body including a suction motor;

a nozzle to suction air and foreign material by using a suction power generated by the suction motor;

a handle disposed between the nozzle and the main body to be gripped by a user;

a communication unit to receive power information including price information from an external;

a power management unit to receive the power information from the communication unit, the power management unit to determine a number of cleaning functions available to the vacuum cleaner among the plurality of cleaning functions based on the received power information; and a display unit to display the number of the cleaning functions determined by the power management unit to be available to the vacuum cleaner, wherein the power management unit supplies an operating power of the vacuum cleaner in an energy saving mode or a normal mode according to the price information provided through the external, wherein, in the normal mode, the power management unit causes the display unit to display all the plurality of cleaning functions, and in the energy saving mode, the power management unit causes the display unit to display the cleaning functions from among the plurality of cleaning functions that are available in the energy saving mode.

2. The vacuum cleaner according to claim 1, wherein when the power management unit determines that a power supply amount is sufficient to operate all the plurality of cleaning functions, the power management unit causes the display unit to indicate that the vacuum cleaner can operate in the normal mode.

3. The vacuum cleaner according to claim 2, wherein when the power management unit determines that the power supply amount is not sufficient to operate all the plurality of cleaning functions, the power management unit causes the display unit to indicate that the vacuum cleaner can operate in the energy saving mode.

4. The vacuum cleaner according to claim 3, wherein when the power management unit determines that the power supply amount is not sufficient to operate in the normal mode after previously determining that the power supply amount was sufficient to operate in the normal mode, the power management unit causes display unit to indicate that the vacuum cleaner can operate in the energy saving mode, and causes the display unit to display the cleaning functions from among the plurality of cleaning functions that are available in the energy saving mode.

5. The vacuum cleaner according to claim 4, wherein the display unit comprises: a main display unit to display the power information that includes the price information and a power supply amount for each power supply source from the external; and a sub display unit to display the number of cleaning functions determined by the power management unit to be available to the vacuum cleaner based on the power supply amount.

6. The vacuum cleaner according to claim 5, wherein the main display unit is disposed at the main body, and the sub display unit is disposed at the handle.

7. The vacuum cleaner according to claim 6, further comprising a power management button, wherein the power management button is used to select a power supply source from among a plurality of power supply sources and the power management button is disposed at the main display unit.

8. The vacuum cleaner according to claim 7, wherein the power management button comprises a selection button to cause the power management unit to change a power supply source displayed on the main display unit each time the selection button is pressed, and a confirmation button to confirm a power supply source as the power supply source to receive power when the confirmation button is pressed.

9. The vacuum cleaner according to claim 5, wherein the power management unit causes a chroma in a background of the main display unit to be displayed based on the power supply amount of the power supply source.

10. The vacuum cleaner according to claim 5, wherein the sub display unit is located at the handle of the vacuum cleaner, and the sub display unit further comprises a mode display unit to display the normal mode or the saving mode, and a function display unit to display available cleaning functions based on the normal mode or the savings mode.

11. The vacuum cleaner according to claim 10, further comprising a control button to select a cleaning function from the available cleaning functions.

12. The vacuum cleaner according to claim 5, wherein the main display unit displays a power consumption amount or an electricity charge after one of the plurality of cleaning functions is performed.

13. The vacuum cleaner according to claim 1 further comprising a plug insertable into a socket to receive a power supply, wherein the communication unit is included in the plug to receive the power information.

14. A vacuum cleaner to perform a plurality of cleaning functions, comprising:

a main body including a suction motor;

a nozzle to suction air and foreign material by using a suction power generated by the suction motor;

a handle disposed between the nozzle and the main body to be gripped by a user;

a communication unit to receive power information including price information from an external;

a power management unit to receive the power information from the communication unit, the power management unit to determine a number of cleaning functions available to the vacuum cleaner among the plurality of cleaning functions based on the received power information; and a display unit to display the number of the cleaning functions determined by the power management unit to be available to the vacuum cleaner, wherein the power management unit supplies an operating power of the vacuum cleaner in an energy saving mode or a normal mode according to the price information provided through the external, wherein when the power management unit determines that a power supply amount is sufficient to operate all the plurality of cleaning functions, the power management unit causes the display unit to indicate that the vacuum cleaner can operate in the normal mode, and causes the display unit to display all the plurality of cleaning functions.

* * * * *